US005657903A

United States Patent [19]

Roberts

[11] Patent Number: 5,657,903

[45] Date of Patent: Aug. 19, 1997

[54] DEVICE FOR EMPTYING CONTENTS FROM A FLEXIBLE CONTAINER

[76] Inventor: Jodie Schmidt Roberts, 7121 Downing Dr., Knoxville, Tenn. 37909

[21] Appl. No.: 633,566

[22] Filed: Apr. 17, 1996

[51] Int. Cl.[6] ..... B65D 35/28

[52] U.S. Cl. ..... 222/102; 222/95

[58] Field of Search ..... 222/95, 103, 102

[56] References Cited

U.S. PATENT DOCUMENTS

| | | | |
|---|---|---|---|
| 2,921,718 | 1/1960 | Meissner | 222/103 |
| 3,142,074 | 7/1964 | Reich | 222/95 X |
| 3,248,012 | 4/1966 | Adams | 222/95 |
| 3,371,823 | 3/1968 | Petersen | 222/97 |
| 3,536,234 | 10/1970 | Rise | 222/103 |
| 3,734,351 | 5/1973 | Gaudin | 222/103 |
| 3,768,699 | 10/1973 | Robe, Jr. | 222/103 |
| 3,993,220 | 11/1976 | Troy | 222/95 X |
| 4,157,771 | 6/1979 | Smith | 222/103 |
| 4,159,787 | 7/1979 | Wright | 222/103 |
| 4,365,727 | 12/1982 | Shmelkin | 222/97 |
| 4,448,330 | 5/1984 | Roux | 222/101 |
| 4,599,758 | 7/1986 | Stiles | 7/158 |
| 4,928,851 | 5/1990 | Eatherly | 222/103 |
| 5,071,036 | 12/1991 | Kelly et al. | 222/103 |
| 5,118,011 | 6/1992 | Kopp | 222/102 |
| 5,277,335 | 1/1994 | Okami et al. | 222/102 |
| 5,372,282 | 12/1994 | Barchus | 222/102 |

*Primary Examiner*—Gregory L. Huson
*Attorney, Agent, or Firm*—Pitts & Brittian, P.C.

[57] ABSTRACT

A device (10) for emptying sauce bags and the like for assist in the evacuation of contents (56) from a conventional flexible container (50). The device (10) is especially designed to evacuated heated contents (56) from a flexible container (50) in such a manner that the user is not required to directly contact any portion of the container (50) which is heated, thus protecting the user's hands. The device (10) provides the added utility of removing substantially all of the contents (56) from within the container (50). The device (10) includes a handle (12) and a pair of engagement members (16). The engagement members (16) are substantially parallel one to the other, and are closely spaced apart to define a narrow slot (38) through which the flexible container (50) is received. The slot (38) is defined from the distal ends (18) of the engagement members (16) and terminates proximate the handle (12). The distal ends (18) of the engagement members (16) are free ends such that the bag or container (50) may be received therebetween.

9 Claims, 3 Drawing Sheets

DEVICE FOR EMPTYING CONTENTS FROM A FLEXIBLE CONTAINER

DEVICE FOR EMPTYING SAUCE BAGS AND THE LIKE

1. Technical Field

This invention relates to the field of cooking. More specifically, the present invention relates to a device for assisting in the evacuation of contents from within a collapsible container, and especially heated contents which are difficult to handle with one's unprotected hands.

2. Background Art

In the field of cooking it is well known that many foods are prepackaged in sealed plastic bags. Such prepackaged foods are not only stored in the sealed bags, but are also intended to be cooked in the same plastic bags as a matter of convenience. The foods are typically either placed in boiling water in the bags or may be cooked in a conventional microwave. However, cooking foods in these exemplary manners creates a problem in that removing the cooked foods from the bags within which they are cooked can cause burns if proper caution is not taken. The elevated temperature of the contents also makes the removal of the entire contents from the bag difficult. Thus, it is desirable to provide a device for safely evacuating the entire contents from a bag, wherein the contents may be heated.

Other devices have been produced to assist in evacuating contents from within a pliable container. For example, many devices have been provided for evacuating the contents from a toothpaste tube. Still others have been provided for evacuating heated contents from a plastic-type bag. Typical of the art are those devices disclosed in the following U.S. patents:

| U.S. Pat. No. | Inventor(s) | Issue Date |
|---|---|---|
| 2,921,718 | W. E. Meissner | Jan. 19, 1960 |
| 3,371,823 | V. A. Petersen | Mar. 5, 1968 |
| 3,536,234 | L. Rise | Oct. 27, 1970 |
| 3,734,351 | J. J. Gaudin | May 22, 1973 |
| 3,768,699 | H. K. Robe, Jr. | Oct. 30, 1973 |
| 4,157,771 | E. M. Smith | June 12, 1979 |
| 4,159,787 | S. Wright | July 3, 1979 |
| 4,365,727 | M. Shmelkin | Dec. 28, 1982 |
| 4,448,330 | P. Roux | May 15, 1984 |
| 4,599,758 | R. G. Stiles | July 15, 1986 |
| 4,928,851 | P. C. Eatherly | May 29, 1990 |
| 5,071,036 | H. Kelly, et al. | Dec. 10, 1991 |
| 5,118,011 | R. A. Kopp | June 2, 1992 |
| 5,277,335 | A. S. Okami, et al. | Jan. 11, 1994 |
| 5,372,282 | D. D. Barchus | Dec. 13, 1994 |

Of these devices, those disclosed by Wright ('787); Stiles ('758); Eatherly ('851); Kelly, et al. ('036); and Okami, et al. ('335) are devices which are each provided with a slotted opening for receiving one end of a tube or bag. The tube or bag is emptied by holding the device with one hand and pulling the tube or bag through the slotted opening. However, these devices require the user to grasp the device proximate the slotted opening. Thus, when heated contents are being removed, an undesirable risk of burns to the hand remains.

The remainder of the above devices are mechanical devices using springs, levers, and other components to assist in the evacuation of flexible containers. In these devices, the contents of the containers are removed by either pulling the container between members biased toward each other, or by pressing the bag to expel the contents through an opening in the periphery of the container. As in the previous devices, the latter devices each define a slotted opening for receiving the container therethrough. In order to insert the container into the slotted openings of each of the above devices, the container must be handled in such a manner that if the contents were heated, the handler would sustain burns, with the exception of the Meissner ('718) device. Meissner teaches a device including a bucket and a lid. The lid defines an opening through which the bag with heated contents is inserted. Two opposing hinged doors are provided such that when the container is withdrawn from the lid opening, the hinged doors are pulled toward each other such that the contents of the bag are evacuated therefrom. The bag used in association with the Meissner device is also a non-conventional bag having a discrete grasping portion. However, conventional bags provided for heating the contents therein are typically provided with no more than the periphery defined by the fusion of two layers of material which form the bag.

Thus, the prior art of record is devoid of teaching a device in which the heated contents of a conventional flexible container may be evacuated without potential harm to a user's hands. Further, the prior art fails to teach a device which allows for the insertion of a container into the slotted opening defined by the particular device whereby the user may grasp the fringe of the container, insert the container, and pull the container through the device to evacuate the contents therefrom without releasing the container.

Therefore, it is an object of this invention to provide a means for evacuating the contents of a conventional flexible container in which the contents are typically heated.

Another object of the present invention is to provide a means whereby the container may be inserted into an opening defined by the device while requiring one to grasp only a fringe of the container, the fringe typically being at room temperature.

A further object of the present invention is to provide such a device which is simple to use and inexpensive to manufacture.

DISCLOSURE OF THE INVENTION

Other objects and advantages will be accomplished by the present invention which serves to assist in the evacuation of contents from a conventional flexible container. The device is especially designed to evacuated heated contents from a flexible container in such a manner that the user is not required to directly contact any portion of the container which is heated, thus protecting the user's hands. The device provides the added utility of removing substantially all of the contents from within the container.

The device includes a handle and a pair of engagement members. The engagement members are substantially parallel one to the other, and are closely spaced apart to define a narrow slot through which the flexible container is received. The slot is defined from the distal ends of the engagement members and terminates proximate the handle. The engagement members may be integrally formed with the handle, or may be mounted thereto such as to allow rotation about their respective central axes. The distal ends of the engagement members are free ends such that the bag or container may be received therebetween. Thus, the user is not required to release the container or bag during the emptying process.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A device for emptying sauce bags and the like incorporating various features of the present invention is illustrated generally at 10 in the figures. The device for emptying sauce bags and the like, or device 10, is designed for assisting in the evacuation of contents 56 from a conventional flexible container 50. The device 10 is especially designed to evacuated heated contents 56 from a flexible container 50 in such a manner that the user is not required to directly contact any portion of the container 50 which is heated, thus protecting the user's hands. The device 10 provides the added utility of removing substantially all of the contents 56 from within the container. It will be understood that although the device 10 is described as being useful for the evacuation of heated contents from a flexible container 50, the device 10 may be equally useful for the evacuation of non-heated contents from a flexible container 50 as well. For instance, the device 10 is useful for emptying condiment packets, packets of syrup such as would be included in many baked goods mixes, and the like.

Figure 1:
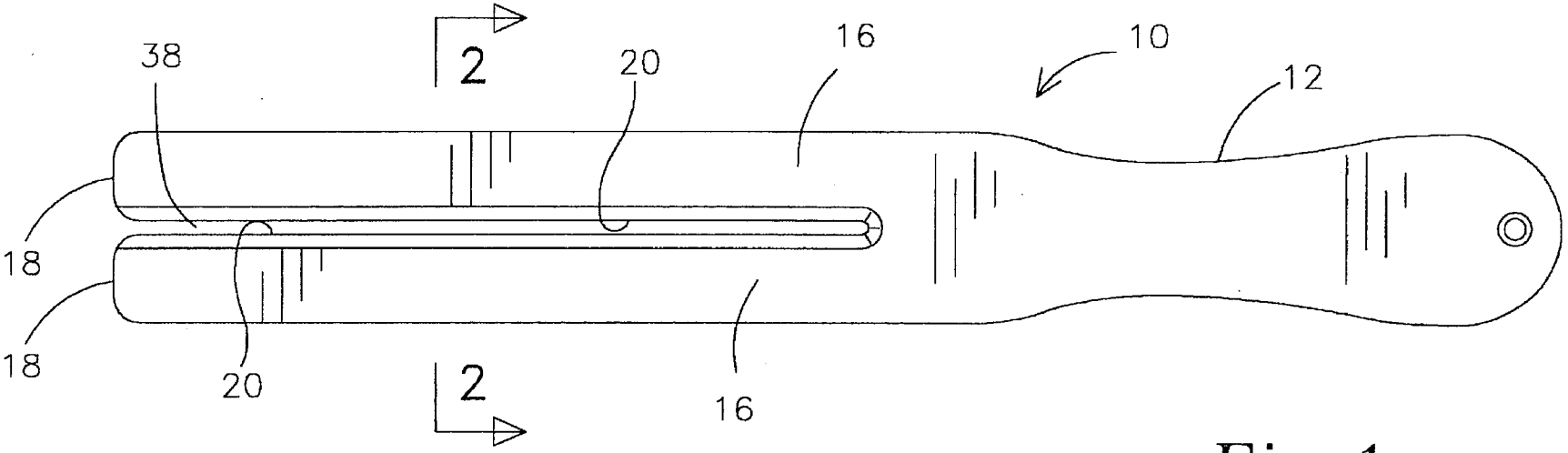
FIG. 1 is a top plan view of one embodiment of the device for emptying sauce bags and the like constructed in accordance with several features of the present invention.
Figure 2:
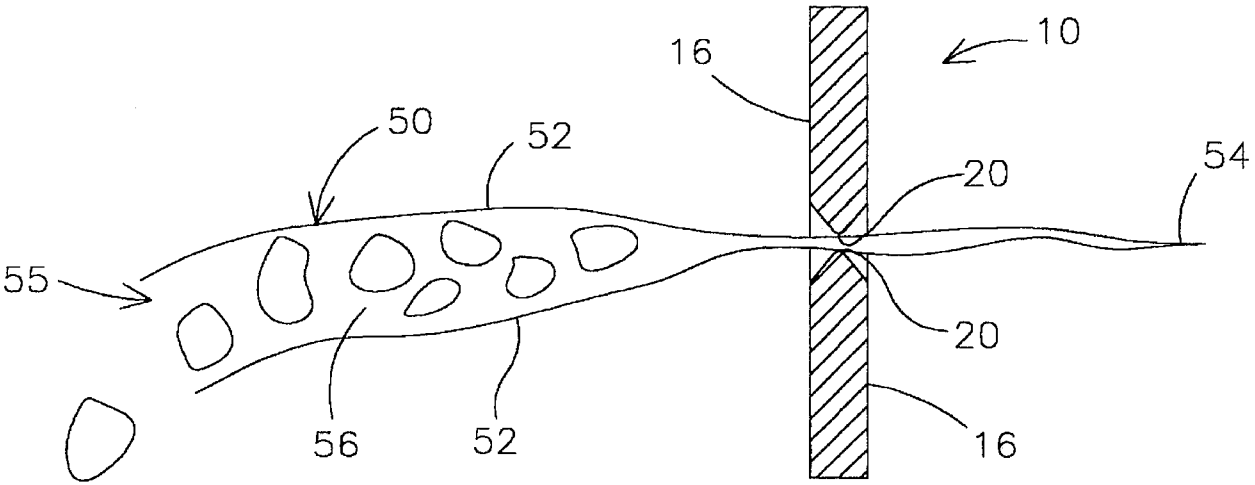
FIG. 2 illustrates an end elevation view, in section, of the device for emptying sauce bags and the like taken at 2—2 of FIG. 1.

FIGS. 1 and 2 illustrate a first preferred embodiment of the present invention. The device 10 includes a handle 12 and a pair of engagement members 16. The engagement members 16 are substantially parallel one to the other, and are closely spaced apart to define a narrow slot 38 through which the flexible container 50 is received. The slot 38 is defined from the distal ends 18 of the engagement members 16 and terminates proximate the handle 12. The distal ends 18 of the engagement members 16 are free ends such that the flexible container 50 may be received therebetween without requiring the release of the container 50 during the evacuation process. In the embodiment illustrated in FIGS. 1 and 2, the handle 12 and engagement members 16 are preferably integrally formed for ease of manufacture. The proximate edges 20 of the engagement members 16 each define a taper such that the surface area of the device 10 engaged by the container 50 is minimized, thus minimizing the amount of force required to draw the container 50 between the engagement members 16.

Because the slot 38 extends to the distal ends 18 of the engagement members 16, insertion of the flexible container 50 is simplified. To empty a bag 50, the user simply grasps the fringe 54 of the bag 50 at a point away from an opening 55 defined in the bag 50 (illustrated in FIG. 2) with one hand, and with the other hand, the user places the device 10 such that the distal ends 18 of the engagement members 16 are proximate the bag fringe 54. The bag 50 and device 10 are then moved toward one another such that the engagement members 16 are on either side of the bag 50. The bag 50 is then drawn through the slot 38 such that the engagement members 16 force the contents 56 from within the bag 50 through the opening 55. The fringe 54 of one conventional bag 50, as illustrated, is formed by ultrasonic welding or otherwise fusing the peripheries of two plastic sheets 52. Due to the close proximity of the two engagement members 16, a substantial portion of the contents 56 of the bag 50 are evacuated with a single pass of the bag 50 through the slot 38 defined between the engagement members 16.

By requiring one to only handle the fringe 54 of the bag 50, the user need not contact the portion of the bag 50 which directly contacts the heated contents 56. Thus, the device 10 minimizes the potential for burns while emptying the bags 50.

The device 10 of the present invention may be fabricated from any conventional material such as aluminum or plastic. In the preferred embodiment, the material of fabrication defines a low heat conductivity to further prevent burns.

Figure 3:
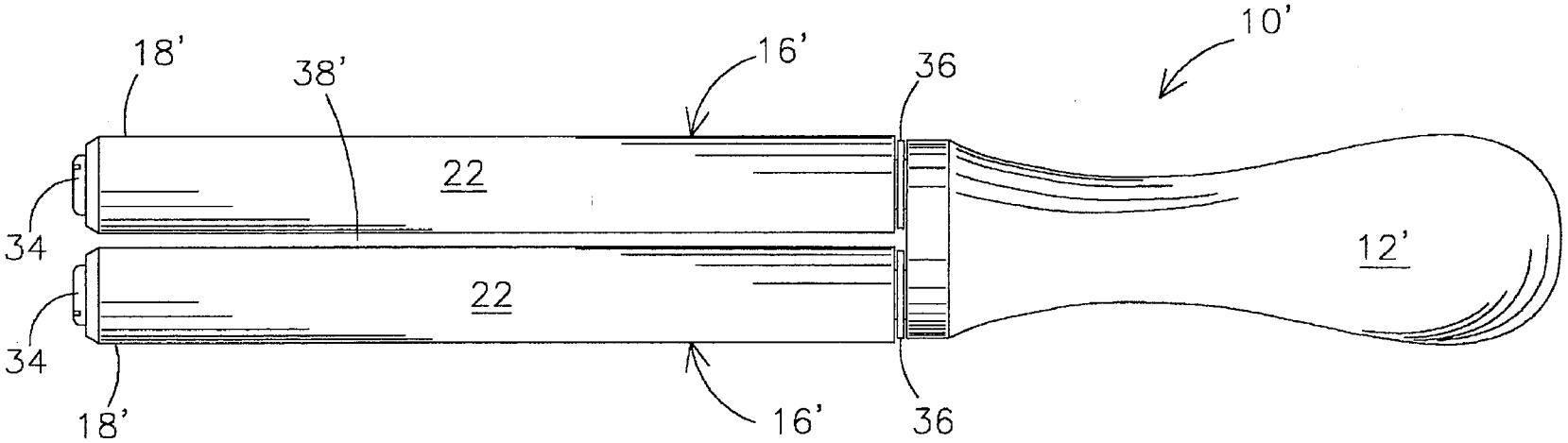
FIG. 3 is a top plan view of an alternate embodiment of the device for emptying sauce bags and the like constructed in accordance with several features of the present invention.
Figure 4:
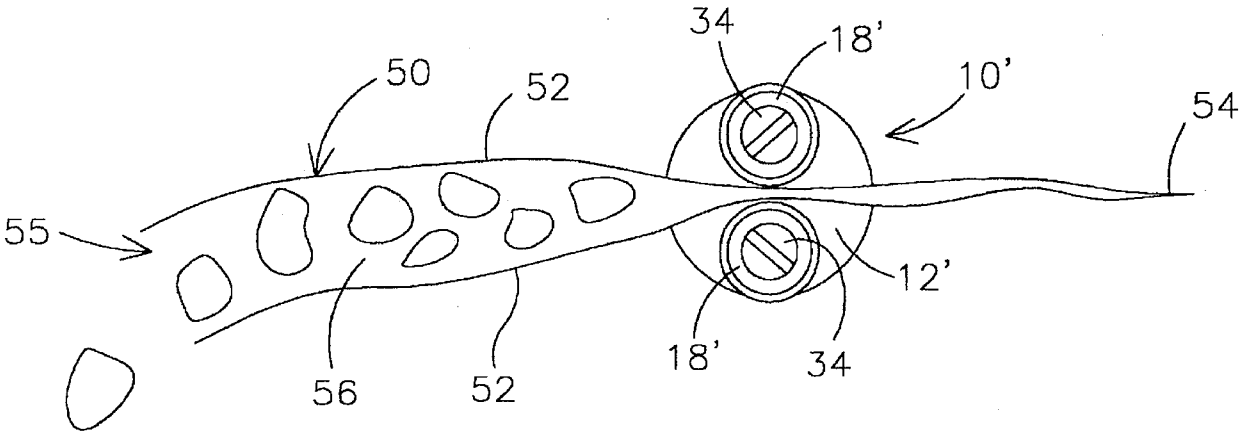
FIG. 4 illustrates an end elevation view of the device for emptying sauce bags shown in FIG. 3.
Figure 5:
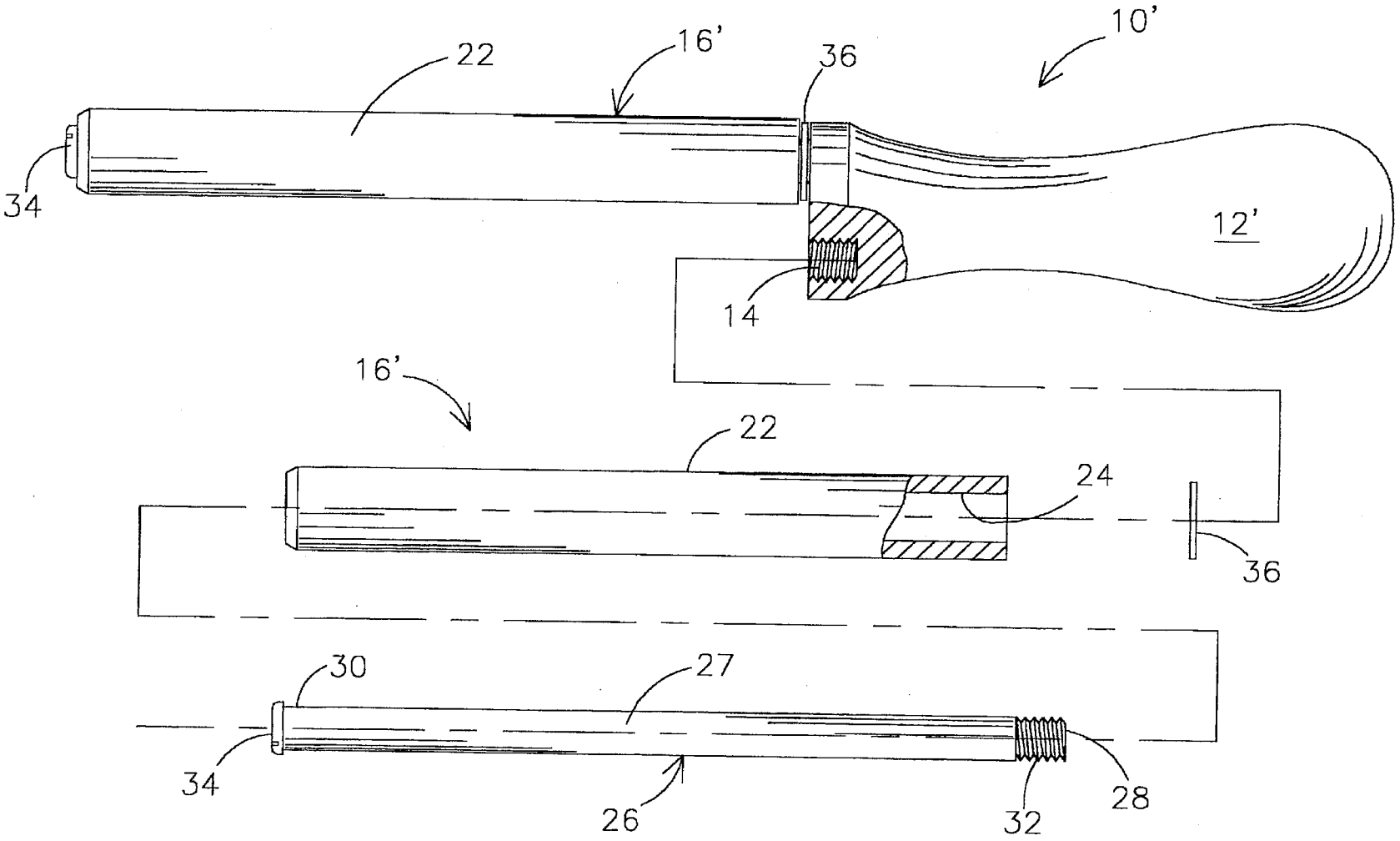
FIG. 5 illustrates a partially exploded view of the device for emptying sauce bags shown in FIG. 3.

FIGS. 3–5 illustrate a second preferred embodiment in which the handle 12' defines a circular cross-section, and wherein each engagement member 16' includes a roller 22 received on a threaded rod 26. A slot 38' is defined between the engagement members 16', as in the previous embodiment. As best illustrated in FIG. 5, the handle 12' defines two threaded receptors 14 for engagement of a threaded portion 32 of each threaded rod 26. Each roller 22 defines a substantially cylindrical wall having an inner wall 24 dimensioned to loosely receive a threaded rod 26. Each threaded rod 26 includes a shaft 27 defining a threaded portion 32 at a proximal end 28 and head 34 at a distal end 30 for assisting in the securement thereof to the handle 12' and for limiting the axial movement of the roller 22 in which it is received. The shaft 27 defines a length sufficient to allow rotation of the roller 22 around the shaft 27 without binding. Thus, each shaft 27 of the preferred embodiment is slightly longer that each roller 22. In the illustrated embodiment, a washer 36 is received between the proximal end 28 of each roller 22 and the handle 12' to aid in the rotation of the roller 22 about the respective shaft 27.

The method for using the latter embodiment is similar to that of the first embodiment. Due to the rotation of the rollers 22 about their respective shafts 27, the forces required for pulling the bag 50 through the slot 38' defined between the engagement members 16' is further reduced. Further, the materials of manufacture are similar to the first described embodiment.

From the foregoing description, it will be recognized by those skilled in the art that a device for emptying sauce bags and the like offering advantages over the prior art has been provided. Specifically, the device provides a means for evacuating the contents of a flexible container such as a plastic bag provided for storage and preparation of food. For bags wherein food items are heated, the present invention serves to reduce the risk of injury due to burns caused by contact of the bag proximate the heated food. The present invention also provides a device such that a substantial portion of the contents of the bag are emptied with a single pass of the bag through the device. Although the device is specifically described as being used for evacuating food items from a bag, it will be understood that the device of the present invention may be used to evacuate the contents from any conventional flexible or collapsible bag.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A device for emptying contents from a flexible container, said device comprising:

a handle defining a one-piece construction; and a pair of engagement members carried by said handle, said engagement members being disposed parallel one to the other and positioned to define a slot therebetween for receipt of the flexible container, said engagement members each defining a free distal end for receipt of at least a portion of the flexible container therebetween, each of said pair of engagement members defining an edge proximate the other of said pair of engagement members, each said edge defining a taper for minimizing a surface area contacted by the flexible container as the flexible container is pulled through said slot.

2. The device of claim 1 wherein said device is fabricated from aluminum.

3. The device of claim 1 wherein said device is fabricated from plastic.

4. A device for emptying contents from a flexible container, said device comprising:

a one-piece member defining a handle and an integrally-formed pair of engagement members extending from said handle, said engagement members being disposed parallel one to the other and positioned to define a slot therebetween for receipt of the flexible container, said engagement members each defining a free distal end for receipt of at least a portion of the flexible container therebetween, each of said pair of engagement members defining an edge proximate the other of said pair of engagement members, each said edge defining a taper for minimizing a surface area contacted by the flexible container as the flexible container is pulled through said slot.

5. The device of claim 4 wherein said device is fabricated from aluminum.

6. The device of claim 4 wherein said device is fabricated from plastic.

7. A device for emptying contents from a flexible container, said device comprising:

a handle; and a pair of engagement members carried by said handle, said engagement members being disposed parallel one to the other and positioned to define a slot therebetween for receipt of the flexible container, said engagement members each defining a free distal end for receipt of at least a portion of the flexible container therebetween, each of said pair of engagement members including a cylindrical roller defining an inner wall dimensioned to receive a shaft, said shaft defining a threaded portion for engaging a threaded receptor defined by said handle, a distal end of said shaft defining a head for limiting axial movement of said cylindrical roller with respect to said shaft.

8. The device of claim 7 wherein said device is fabricated from aluminum.

9. The device of claim 7 wherein said device is fabricated from plastic.

* * * * *